United States Patent [19]

Wheeler et al.

[11] 4,316,595

[45] Feb. 23, 1982

[54] CONCRETE POST FORMING APPARATUS

[75] Inventors: Ronald M. Wheeler; Joan L. Muirhead, both of Vicksburg, Miss.

[73] Assignee: Ronald M. Wheeler, Vicksburg, Miss.

[21] Appl. No.: 201,229

[22] Filed: Oct. 27, 1980

[51] Int. Cl.[3] ..... B22D 5/00

[52] U.S. Cl. ..... 249/94; 249/96; 249/119; 249/122; 249/123; 249/125; 249/144; 264/228

[58] Field of Search ..... 249/94, 96, 119, 122, 249/123, 125, 144; 264/228

[56] References Cited

U.S. PATENT DOCUMENTS

| | | | |
|---|---|---|---|
| 838,737 | 12/1906 | Moore | 249/94 |
| 1,186,554 | 6/1916 | Crisenberry | 249/94 |
| 1,657,011 | 1/1928 | Joslin | 249/129 |
| 4,133,371 | 1/1979 | Birch | 249/119 |

*Primary Examiner*—James R. Hall

*Attorney, Agent, or Firm*—Laubscher, Philpitt & Laubscher

[57] ABSTRACT

A concrete post molding device is disclosed for simultaneously forming a plurality of uniform, reinforced concrete posts. The device includes a housing containing an annular chamber defined by a fixed horizontal first plate having a central cylindrical pipe and a spaced concentrically arranged sleeve vertically supported thereon. A plurality of circumferentially spaced radial fin members are connected with the pipe for dividing the chamber into a plurality of circumferentially arranged vertical compartments, and the first plate contains a plurality of openings arranged opposite the compartments. The concrete post molding device is characterized by novel reinforcing rod suspension and tensioning apparatus. An annular ring is connected with the upper portion of the pipe and includes a plurality of first chucks for gripping the upper portions of the reinforcing rods. The lower portions of the rods are suspended in spaced relation in the compartments and extend vertically through the first plate openings. The lower portions of the rods are clamped to a second horizontal plate arranged beneath the first plate, and the second plate is displaced downwardly relative to the first plate to tension the rods. When concrete is delivered to the compartments, a plurality of reinforced concrete posts are cast simultaneously.

10 Claims, 7 Drawing Figures

Fig. 3
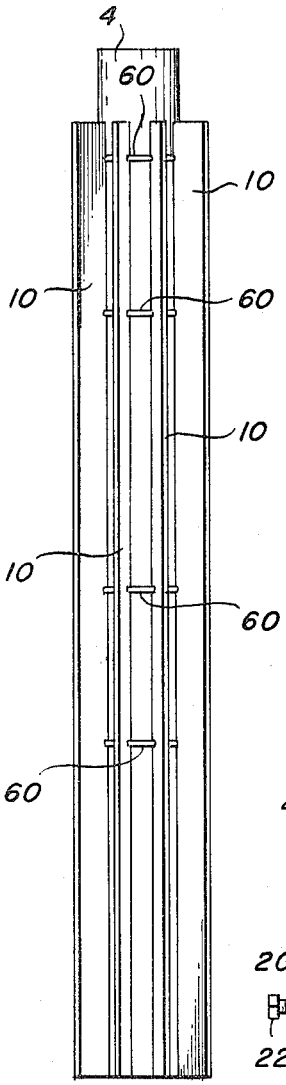
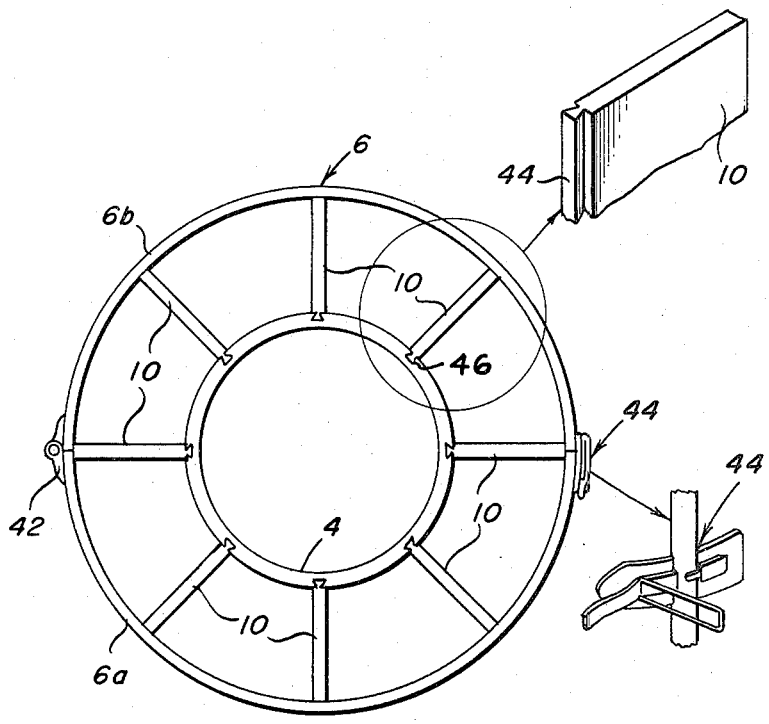
Fig. 4
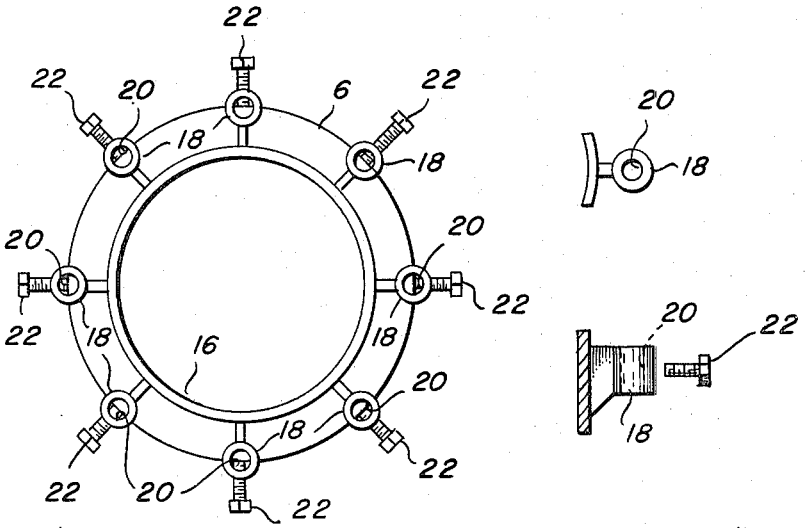
Fig. 5
Fig. 3a
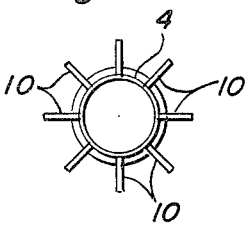

CONCRETE POST FORMING APPARATUS

BRIEF DESCRIPTION OF THE PRIOR ART

Concrete fence posts have been in existence for many years but have generally not been competitive with wooden and metal fence posts due to their increased weight, difficulty in manufacture, and greater cost.

Various concrete post molding devices are well-known in the prior art as evidenced by the patents to Joslin U.S. Pat. No. 1,657,011, Moore U.S. Pat. No. 828,737, and Crisenberry U.S. Pat. No. 1,186,554.

The Joslin patent discloses a multiple form for casting concrete posts and includes a central post, a plurality of radial plates and a plurality of circumferential plates arranged between the radial plates to define a plurality of triangular compartments. A steel reinforcing bar may be placed in each corner of the compartment and the assembly is held together by a pair of circumferential straps. Concrete is delivered to the form and a plurality of posts are simultaneously cast.

The patent to Moore discloses a mold for concrete posts which includes means for supporting vertical reinforcing wires within the mold while the post is being formed. Similarly, the Crisenberry patent discloses a concrete fence post mold including means for holding a plurality of reinforcing wires in a taut condition while concrete is being poured therein.

While the prior devices normally operate quite satisfactorily, they each possess inherent drawbacks which tend to complicate the post forming process, thereby increasing the cost of production. The Joslin device, for example, is formed of a plurality of plates which must be assembled and taken apart for each group of posts being formed. Furthermore, the wire support mechanisms of the Moore and Crisenberry devices are not suitable for accurately supporting a relatively stiff reinforcing rod within a mold forming compartment. Finally, none of the aforementioned devices are suitable for automation to continuously produce a plurality of uniform concrete posts.

The present invention was developed to overcome the aforementioned and other disadvantages of the prior art by providing apparatus for simultaneously forming a plurality of reinforced concrete posts which is simpler and comprises fewer parts than the prior devices in order to quickly and economically mass produce a plurality of concrete posts.

SUMMARY OF THE INVENTION

Accordingly, it is a primary object of the present invention to provide a device for forming a plurality of reinforced concrete posts wherein the device includes improved reinforcing rod suspension and tensioning apparatus. The device includes a housing having a fixed horizontal first plate, a vertically arranged central cylindrical pipe supported on the first plate, and an outer cylindrical sleeve arranged in concentrically spaced relation about the pipe and supported on the first plate to define an annular chamber between the pipe and the sleeve. A plurality of radial fin members connected with the pipe divide the chamber into a plurality of circumferentially arranged vertical compartments. A plurality of reinforcing rods are suspended in spaced relation within the compartments by suspension apparatus including an annular ring connected with the upper portion of the pipe and a plurality of chucks connected with the ring and arranged opposite the compartments.

The rods extend vertically through the compartments and through a plurality of respective openings in the first plate, and the lower ends of the rods are clamped to a horizontal second plate arranged beneath the first plate. The second plate is displaced downwardly relative to the fixed first plate to tension the rods. When concrete is delivered to the compartments and allowed to set, a plurality of reinforced concrete posts are formed simultaneously.

It is a more specific object of the invention to include apparatus for removing the sleeve from the housing to permit removal of the concrete posts.

According to a further object of the invention, the annular ring and the plurality of vertical fin members are integrally connected with the pipe.

It is another object of the invention to provide an outer shell comprising a pair of semicylindrical sections.

It is yet another object of the invention to provide a plurality of fluid cylinders for removing the shell sections and for displacing the second plate.

BRIEF DESCRIPTION OF THE FIGURES

These and other objects of the invention will become apparent from a study of the following specification when viewed in the light of the accompanying drawing in which:

FIGS. 3 and 3*a* are front and top plan views, respectively, of the central pipe and integral fin members of the device; FIG. 4 is a top view of the device having a hinged outer shell and having the fin members connected with the pipe by a key and groove;

FIG. 5 is a top view of the annular ring and radial chucks of the rod suspension apparatus.

DETAILED DESCRIPTION

Figures 1, 2:
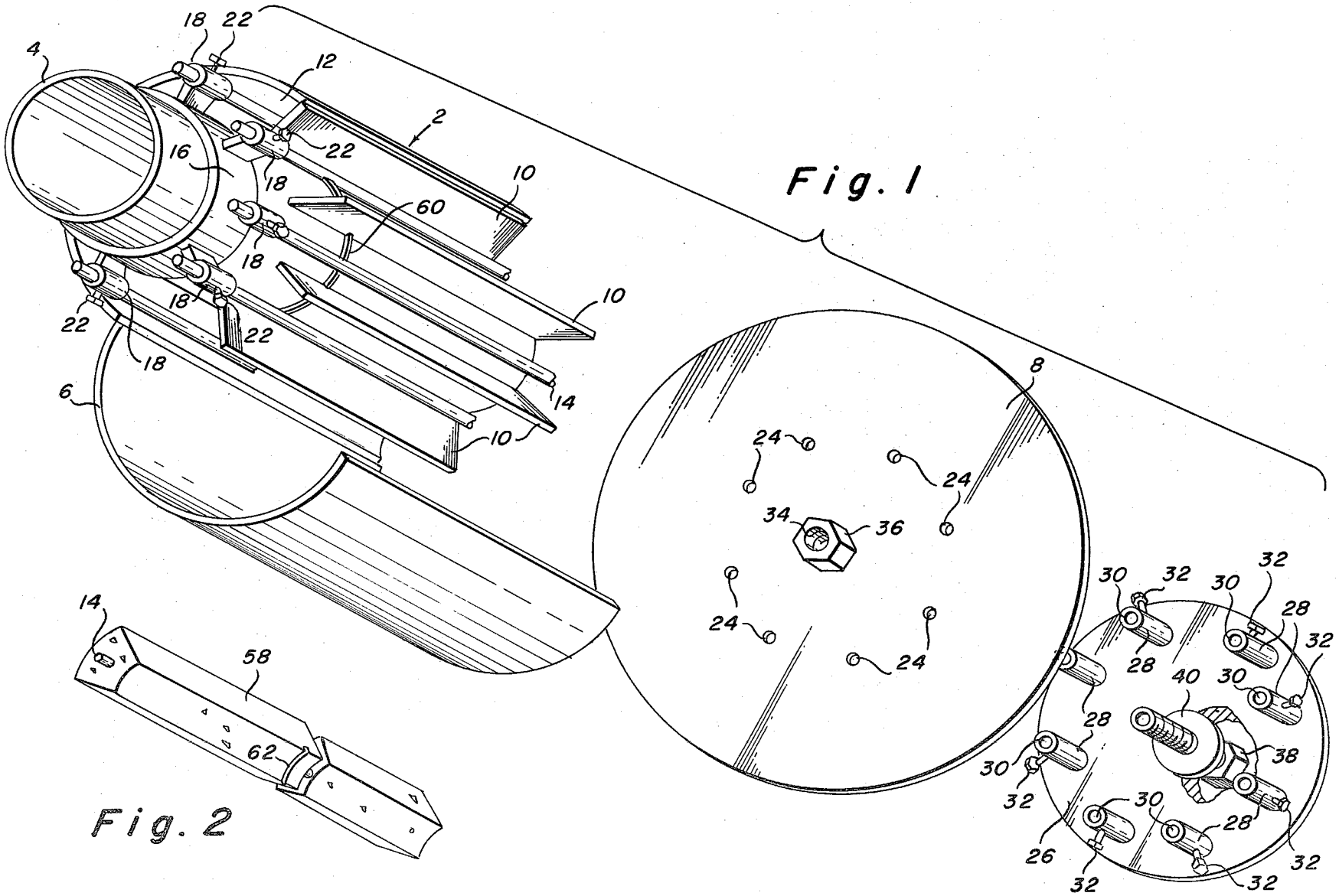
FIG. 1 is an exploded perspective view of a preferred embodiment of the concrete post molding device.
FIG. 2 is a perspective view of a post formed in the device of FIG. 1.

The present invention is directed toward a device for forming reinforced concrete posts. Referring first to FIG. 1, a first embodiment of the invention will be described. The device includes a housing 2 containing an annular chamber defined by a central cylindrical hollow pipe 4, an outer cylindrical sleeve 6 arranged in concentrically spaced relation about the pipe, and a fixed plate 8 arranged normal to the pipe and sleeve to close the bottom of the chamber. As shown more particularly in FIGS. 3 and 3*a*, the pipe has a vertical axis and includes a plurality of radially outwardly extending vertical fins 10 circumferentially arranged about and integrally connected with the outer surface of the pipe.

As shown in FIG. 1, the fins divide the annular chamber into a plurality of concrete post forming compartments 12. Each compartment has a reinforcing rod 14 such as a steel rod suspended in spaced relation therein. In the alternative, a plurality of rods may be suspended within each compartment. The rod suspension apparatus includes an upper annular ring 16 connected with the upper portion of the pipe adjacent the upper extremity of the sleeve. The ring may be welded to the pipe or formed integrally therewith.

The upper annular ring 16 of the rod suspension apparatus is shown more particularly in FIG. 5. Extending radially outwardly from the ring are a plurality of chucks 18, one of the chucks being arranged above each of the compartments. Each chuck includes an inner through-bore 20 for receiving the upper portion of a reinforcing rod. A bolt 22 is adapted for securely gripping the rod within the chuck.

Referring once again to FIG. 1, the reinforcing rods extend downwardly through the compartments and through respective openings 24 contained in the plate 8. A second horizontal plate 26 is arranged normal to the axis of the pipe 4 below the plate 8 and includes a plurality of upwardly extending chucks 28 arranged opposite the openings 24. The chucks 28 are similar to the chucks 18 and including an inner through-bore 30 and a tightening bolt 32. The chucks 28 are adapted to receive the lower end portions of the reinforcing rods and tightening of the bolts 32 securely grips the rods within the chucks.

The combination of the upper annular ring 16 including the chucks 18, the openings 24 in the plate 8, and the lower suspension plate 26 including the chucks 28 serves to accurately position a reinforcing rod in spaced relation within each of the compartments. Additional chucks 18 and 28 and additional openings 24 may be provided where more than one rod per compartment is desired.

An important aspect of the rod suspension mechanism is that the lower plate 26 is vertically displaceable in order to tension the reinforcing rods. Specifically, the lower plate is moved to its uppermost position and the rods are inserted through the through-bores 20 of the upper chucks 18, through the openings 24 in the first plate, and into the through-bores 30 of the lower chucks 28. The chuck bolts 22 and 32 are then tightened to securely grip the rods. Finally, the lower plate is displaced downwardly to draw the pipe 4 and the shell 6 into sealing engagement with the fixed plate 8 and to tension the reinforcing rods 14.

One embodiment of a lower plate displacement mechanism is shown in FIG. 1. The fixed plate 8 includes a central aperture 34 above which a threaded nut 36 is welded to the upper surface of the plate. In the alternative, the aperture itself may be threaded and the nut may be omitted. The lower suspension plate 26 includes a central vertically arranged bolt 38 threadably connected with the aperture and nut of the fixed plate. Operation of the bolt in one direction displaces the lower plate upwardly, and operation of the bolt in the other direction displaces the plate downwardly. A washer 40 may be welded to the bolt to limit the vertical displacement of the lower plate.

Referring now to FIG. 4, the outer cylindrical sleeve 6 will be described in greater detail. The sleeve must be removable in order to permit removal of the cast concrete post. Accordingly, the sleeve is formed of a pair of semicylindrical sections *6a, 6b* having open and closed positions. In the closed position, the sleeve sections define the outer cylindrical sleeve of the housing, and in the open position, the sections are spaced from the pipe and fin members. In the embodiment of FIG. 4, the sections are joined along one adjacent vertical edge by at least one hinge 42. The other adjacent vertical edges of the sections are connected with one or more conventional clasps 44. Thus, the sections pivot about the hinge 42 between the open and closed positions.

Also shown in FIG. 4 is an alternative manner for connecting the fins 10 with the pipe. Specifically, the inner edge of each radially outwardly extending fin has a key configuration 44 which is adapted to cooperate with a notch 46 provided in the outer circumferential surface of the pipe 4.

Figure 6:
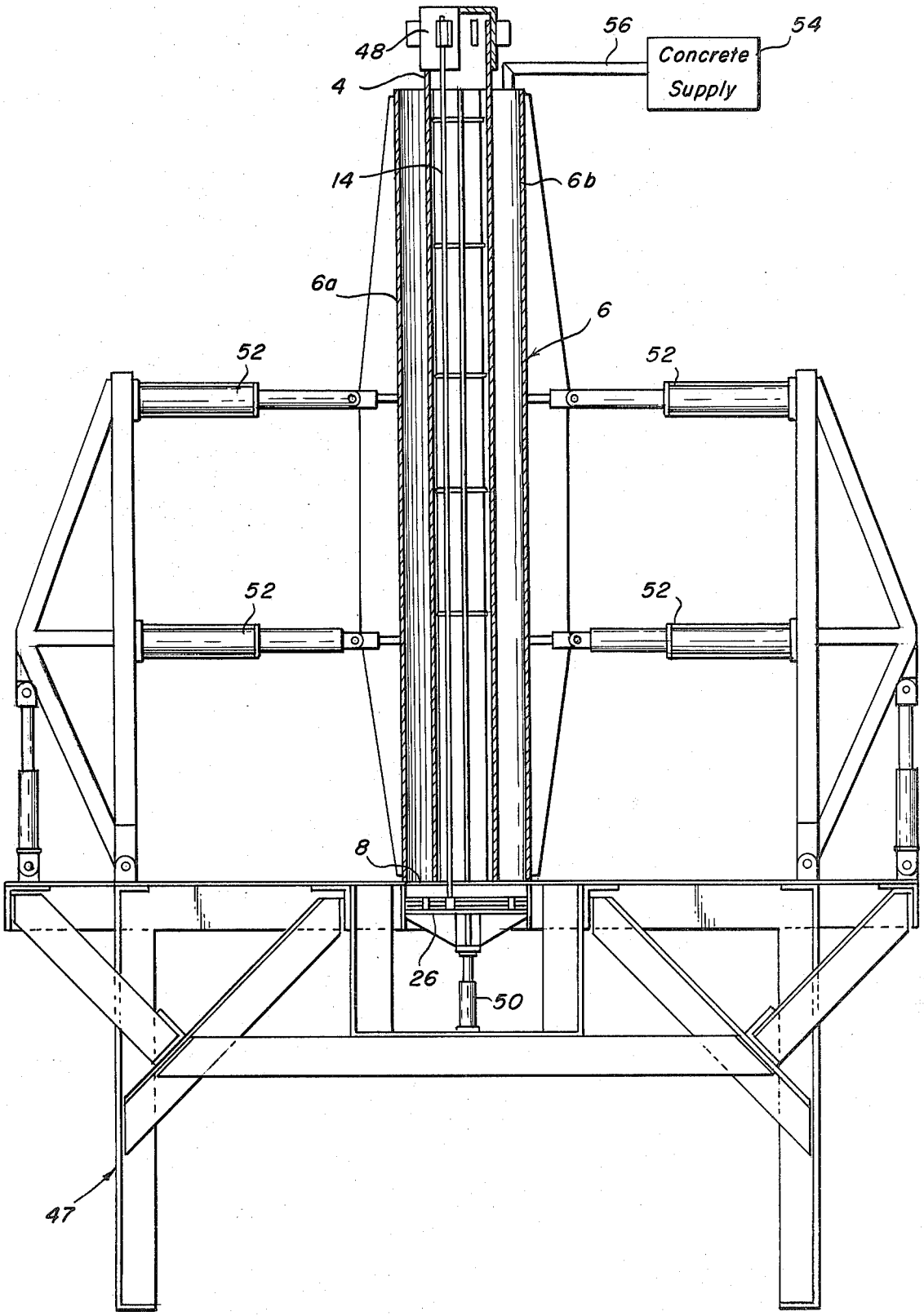
FIG. 6 is a front plan view of an alternative embodiment of the device mounted on a platform.

Referring now to FIG. 6, a second embodiment of the concrete post forming device is shown mounted on a platform 47. In this embodiment, the first fixed plate 8 which closes the bottom of the annular chamber comprises a horizontal surface of the platform. The device of FIG. 6 is similar to that of FIG. 1 except that the upper annular ring comprises a cap 48 which fits over the upper end of the pipe 4 and a plurality of fluid cylinders are provided to displace the lower suspension plate 26 and the sections *6a* and *6b* of the outer cylindrical sleeve. Specifically, a fluid cylinder 50 is connected with the platform and the lower suspension plate 26 for vertically displacing the lower plate relative to the fixed plate 8. Similarly, a plurality of fluid cylinders 52 are operable to displace the sleeve sections between their open and closed positions.

In operation, the sleeve 6 is arranged in its closed position and the reinforcing rods 14 are suspended within the compartments, respectively. The lower plate 26 is vertically displaced to draw the pipe 4 and sleeve 6 downwardly into sealing engagement with the plate 8 and to tension the reinforcing rods. Concrete is then delivered to the compartments from a concrete supply 54 via a hose 56. In the alternative, a concrete funnel (not shown) may be provided to deliver concrete to the compartments.

The concrete is allowed to set within the compartments for a suitable time following which the sleeve sections are displaced to their open position to permit removal of the reinforced concrete post 58 which is shown more particularly in FIG. 2.

The concrete post forming device is of greatly simplified construction and lends itself quite readily to automation. A plurality of the devices may be radially arranged about a central concrete supply. A sensing device may be provided on the fluid cylinder 50 to tension the rods to a desired degree. Suitable control devices may control the delivery of concrete to the plurality of devices and time the operation of the fluid cylinders 52 to open the outer sleeve after a plurality of concrete posts have been simultaneously cast.

The resulting concrete posts are of a uniform strength and configuration. By properly selecting the concrete mixture, the type and size of reinforcing rod used, and the tension applied to the rods, concrete posts of various weight and strength may be provided. The invention is particularly useful for mass producing light weight concrete posts of increased strength. This results from the use of a relatively light concrete formula and the proper tensioning of the rods which serves to compress the resulting post, thereby increasing its strength.

The elements comprising the concrete post forming device and platform are preferably formed of a suitable metal such as cast iron. The central cylindrical pipe, the radially extending fins, and the upper annular suspension ring are preferably cast as an integral unit in order to simplify the device and to facilitate the assembly and operation thereof.

The outer surface of the cylindrical pipe is provided with a plurality of vertically spaced horizontal ridges 60 which result in grooves 62 formed in the surface of the post. The grooves may indicate linear increments of height along the post and serve as a means for fastening a wire or rope to the post.

While in accordance with the provisions of the Patent Statutes the preferred forms and embodiments of the invention have been illustrated and described, it will be apparent to those skilled in the art that various changes and modifications may be made without deviating from the inventive concepts set forth above.

What is claimed is:

1. Molding apparatus for forming a plurality of reinforced concrete posts, comprising (a) housing means (2), including (1) a fixed horizontal first plate (8);

(a) a vertically arranged central cylindrical pipe (4) supported at its lower end on said first plate;

(3) an outer cylindrical sleeve (6) arranged in concentrically spaced relation about said pipe and supported at its lower end on said first plate, thereby to define an annular chamber between said pipe and said sleeve;

(4) a plurality of circumferentially spaced radial fin members (10) connected with said pipe for dividing said chamber into a plurality of circumferentially arranged vertical compartments;

(5) said first plate containing a plurality of openings (24) arranged circumferentially in equally spaced relation opposite said compartments, respectively;

(b) means for suspending a plurality of reinforcing rods in spaced relation within each of said compartments, respectively, the rods being adapted to extend vertically through each of said compartments and said first plate openings, respectively, said suspension means including (1) an annular ring (16) connected with the upper portion of said pipe adajcent the upper extremity of said sleeve; and (2) a plurality of first chuck means (18) connected with said ring and arranged opposite said compartments adapted for gripping the upper portions of the rods, respectively; and (c) tension means adapted for tensioning the reinforcing rods, comprising (1) a horizontal second plate (26) arranged beneath said first plate;

(2) clamping means (28) adapted for clamping the lower ends of the rods to said second plate, respectively; and (3) means for displacing said second plate downwardly relative to said first plate, whereby when a plurality of reinforcing rods are suspended in said compartments by said suspension means and tensioned by said tension means, and when concrete is delivered to said compartments, a plurality of reinforced concrete posts are simultaneously cast.

2. Apparatus as defined in claim 1, and further comprising means for removing said sleeve from said housing, thereby to permit removal of the cast concrete posts from said compartments.

3. Apparatus as defined in claim 2, wherein said clamping means comprises a plurality of second chuck means arranged circumferentially in equally spaced relation opposite said first plate openings, respectively.

4. Apparatus as defined in claim 3, wherein said fin members are connected with said pipe by key and groove means.

5. Apparatus as defined in claim 3, wherein said fin members are integrally connected with said pipe.

6. Apparatus as defined in claim 5, wherein said first plate contains a threaded central aperture, and further wherein said second plate displacing means comprises a bolt threadably connected with said aperture.

7. Apparatus as defined in claim 5, wherein said second plate displacing means comprises fluid cylinder means.

8. Apparatus as defined in claim 5, wherein said sleeve comprises a pair of semicylindrical sections.

9. Apparatus as defined in claim 8, wherein said pair of sections are hingedly connected along one adjacent vertical edge thereof.

10. Apparatus as defined in claim 8, wherein said sleeve removing means comprises a plurality of fluid cylinders.

* * * * *